US008074699B2

(12) United States Patent
Jones et al.

(10) Patent No.: US 8,074,699 B2
(45) Date of Patent: Dec. 13, 2011

(54) ZERO STEP SILL EXTRUDED FLUSH THRESHOLD DOOR SEAL SYSTEM

(75) Inventors: Toby Jones, Carlsbad, CA (US); Matthew W. Power, Encinitas, CA (US)

(73) Assignee: La Cantina Doors, Inc., Vista, CA (US)

( * ) Notice: Subject to any disclaimer, the term of this patent is extended or adjusted under 35 U.S.C. 154(b) by 207 days.

(21) Appl. No.: 12/557,888

(22) Filed: Sep. 11, 2009

(65) Prior Publication Data

US 2010/0064590 A1 Mar. 18, 2010

Related U.S. Application Data

(60) Provisional application No. 61/096,456, filed on Sep. 12, 2008.

(51) Int. Cl.
*E05D 15/26* (2006.01)
*E06B 7/16* (2006.01)
*E06B 1/70* (2006.01)

(52) U.S. Cl. ..... 160/206; 160/40; 160/199; 49/469; 49/475.1; 277/921; 277/644; 277/630; 277/637

(58) Field of Classification Search ..... 160/40, 160/206, 199; 49/469, 475.1, 489.1, 496.1; 277/921, 644, 630, 637, 647; 52/211, 717.01
See application file for complete search history.

(56) References Cited

U.S. PATENT DOCUMENTS

| | | | | | |
|---|---|---|---|---|---|
| 435,658 | A * | 9/1890 | Brennaman | 49/469 |
| 3,535,824 | A * | 10/1970 | Kessler | 49/475.1 |
| 3,654,730 | A * | 4/1972 | Fraleigh | 49/34 |
| 4,170,846 | A * | 10/1979 | Dumenil et al. | 49/303 |
| 5,001,865 | A * | 3/1991 | Procton | 49/469 |
| 5,943,825 | A * | 8/1999 | Procton et al. | 49/469 |
| 6,052,949 | A * | 4/2000 | Procton et al. | 49/506 |
| 6,138,413 | A * | 10/2000 | Fehr | 49/382 |
| 2006/0053695 | A1 * | 3/2006 | Palenske | 49/468 |
| 2007/0272372 | A1 * | 11/2007 | Glover | 160/206 |
| 2008/0229669 | A1 * | 9/2008 | Abdollahzadeh et al. | 49/468 |
| 2010/0066221 | A1 * | 3/2010 | Hakemann | 312/296 |

* cited by examiner

*Primary Examiner* — Blair M Johnson
*Assistant Examiner* — Jaime F Cardenas-Garcia
(74) *Attorney, Agent, or Firm* — Richard D. Clarke

(57) ABSTRACT

The present application is directed to a manual or automatic flush threshold door seal system used on folding exterior doors along with an alternate embodiment for conventional exterior entryway doors that will not impede the passage of a wheelchair. A flexible weather seal can be put in a retracted or down position within an aluminum extrusion imbedded within the threshold providing a flush access surface and may be raised up into the upright position providing an adequate weather seal.

20 Claims, 6 Drawing Sheets

ZERO STEP SILL EXTRUDED FLUSH THRESHOLD DOOR SEAL SYSTEM

FIELD OF THE INVENTION

This application applies to the weather tight sealing of a door threshold by providing a flush threshold lower door seal that will not impede the passage of a wheelchair.

BACKGROUND OF THE INVENTION

The thresholds on doors along with the added height of an adequate weather seal have long been an impediment to the movement of wheelchairs through doorways. There is a growing need for adequately weather sealing of doorways while providing a flush surface to walk through or operate a wheel chair. Conventional thresholds of varying heights with weather strips are a problem for the elderly being a trip hazard when going through. Additionally the weather sealing of doorways is only necessary during inclement weather and the rest of the time the passage of cool air under the door can be a benefit. This unique flush threshold door seal system provides a new and unique sealing method for a wide variety of doorways.

The initial purpose of the design is to provide a weather seal on a flush threshold surface for a variety of folding doors, but it is not limited to folding doors and may be adapted to a variety of door thresholds including hinged entry doorways, garage and warehouse doors or open-air malls along with varying in size for different applications while remaining within the scope of this patent.

The addition of large exterior wall openings incorporating multiple folding doors has become desirable on many elaborate homes, office buildings or open-air malls. With large openings, the conventional thresholds with weather seals or doors with weather seals attached are not desirable and the need for a flush surface is necessary for wheelchair travel.

Numerous innovations for weather sealing doors have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the flush threshold door seal system and the prior art.

U.S. Pat. No. 3,654,730 of Alton L. Fraleigh describes a flexible barrier to be extended across the bottom portion of an opening, for example the door opening in a garage, to intercept foreign matter, such as leaves, snow or dirt. The barrier is preferably formed of elastomeric material and has a broad base to be secured to the floor of the garage and has a flexible wall projecting upwardly from the base in position to engage and prevent said foreign matter from entering the garage, said wall being deflectable to permit a heavy object, such as an automobile, lawn mower, work cart or the like, to pass there over on entering or leaving the garage without interference and will then return to normal position. The wall can be provided with vertical slits to increase the flexibility thereof and can have a laterally disposed lip or deflector portion extending from the upper edge thereof to intercept the foreign material and deflect it back out through said opening.

This patent describes a fixed up-right flexible barrier for door openings in a garage. The folding doors described fold horizontally and are used primarily in garage door applications. It would not be practical to be used as a means of sealing an exterior opening to a residence, office building or open-air mall and it would be a definite impediment to the operation of a wheelchair.

U.S. Pat. No. 4,357,979 of John D. Marontate tells of a skirted, hinged panel for an accordion folding door. A base member is attached to the end of each panel. Each base member mounts a plurality of guides. A flexible seal strip extends continuously along the ends of the panels. It includes an engaging bead configured to engage with the guides, and a flexible band attached to the bead and extending substantially to the adjacent structural surface to seal against the transmission of air, heat, light and sound.

This patent describes a skirted, hinged panel for an accordion folding door. Although this type of sealing means will work over a flush floor surface, it is permanently attached to the lower surface of the doors and drags on the floor every time the doors are opened and closed. It does not incorporate a desirable appearance for high-end homes, office buildings or open-air malls.

U.S. Pat. No. 6,052,949 of Jerome C. Procton et al. describes a building entryway system with a high degree of modularity to accommodate active in swing doors or inactive sidelight panels for use with conventional jambs. Specifically, an extruded aluminum sill is mated with an extruded polymeric receiving unit. The receiving unit defines a U-shaped channel, which accepts a weather strip or panel cap. Either the weather strip or panel cap is slidably positioned within the channel under the door. Additionally a door sweep attached to the active doors sealingly engages the weather strip to prevent water from entering the building.

This patent describes a door seal incorporated into a conventional residential doorway. This invention would not be readily adaptable to a folding door system and exemplifies a trip hazard along with an impediment to wheelchairs.

U.S. Pat. No. 6,345,477 of Steven P. Kepler et al. tells of a door sill assembly that is provided with an adjustable threshold. A sill assembly is made up of an elongated metal frame for installation on the floor of the doorway. The metal frame is provided with a tongue and sloping sill portion, a vertically extending rib and a shelf located below and integrally oriented relative to the rib. The threshold rail is supported on the frame member shelf portion upon two adjustable feet for varying the relative height level of the rail. A plastic threshold cap is sized to fit over the threshold rail and includes a pair of downwardly spaced ribs sized to securely fit over the vertical rib of the frame member to locate the threshold cap and rail relative to the frame member while providing limited vertical adjustment. Preferably, the interior trim molding is provided which is fixed relative to the frame member and oriented inboard of the threshold cap This patent describes another type of door seal incorporated into a conventional residential doorway. This invention would not be readily adaptable to a folding door system and again exemplifies a trip hazard along with an impediment to wheelchairs.

U.S. Pat. No. 6,910,301 of Walenty Kalempa et al. A door seal for use with a bi-parting door in which the door panels of the door have supplementary angled leading edges. One leading edge has a triangular cross-section, while the other has a cross-section similar to a parallelogram. To further the reliability of the door seal, a plurality of magnets with corresponding magnet attracting plates may be attached along the leading edges. Alternatively, both leading edges may have at least one magnet aligned with a magnet on the other edge. With the double magnet configuration, the use of multi-pole magnets is necessary. The magnets also help reduce the bounce between the door panels, which may be closed roughly, and increase the force required to separate the door panels when closed.

Although this patent addresses a door seal for use with bi-parting doors, either sliding or folding doors, it addresses the vertical surfaces and does not take into account the lower surface adjacent to the threshold area. These doors will most likely be used for warehouses, cold storage, freezers and the like.

None of these previous efforts, however, provides the benefits attendant with the flush threshold door seal system. The present design achieves its intended purposes, objects and advantages over the prior art devices through a new, useful and unobvious combination of method steps and component elements, with the use of a minimum number of functioning parts, at a reasonable cost to manufacture and deals with the necessity of convenient handicap access to a wide number of facilities.

In this respect, before explaining at least one embodiment of the in detail it is to be understood that the design is not limited in its application to the details of construction and to the arrangement, of the components set forth in the following description or illustrated in the drawings. The flush threshold door seal system is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the flush threshold door seal system is to provide an adequate flexible weather seal for a folding door entryway.

Another advantage of the flush threshold door seal system is to provide a flush surface entryway that will not present an impediment to the handicap including those in wheelchairs.

Another advantage of the flush threshold door seal system is to provide a flexible weather seal that can be operated manually.

Yet another advantage of the flush threshold door seal system is to provide a flexible weather seal that can be lifted automatically as the doors are closed.

And still another advantage of the flush threshold door seal system is that in the manual configuration the flexible weather seal does not have to be raised every time the doors are closed.

A further advantage of the flush threshold door seal system is that the flexible weather seal is easily lowered by stepping down anywhere on the entire length.

An advantage of an alternate embodiment of the flush threshold door seal system is that it provides a flexible weather seal for a conventional hinged entryway door.

Another advantage of an alternate embodiment of the flush threshold door seal system is that it provides a flush surface entryway that will not present an impediment to the handicap including those in wheelchairs.

These together with other advantages of the flush threshold door seal system, along with the various features of novelty, which characterize the design, are pointed out with particularity in the claims annexed to and forming a part of this disclosure. For a better understanding of the flush threshold door seal system, its operating advantages and the specific objects attained by its uses, reference should be made to the accompanying drawings and descriptive matter in which there are illustrated preferred and alternate embodiments of the flush threshold door seal system. There are additional features of the flush threshold door seal system that will be described hereinafter and which will form the subject matter of the claims appended hereto.

The manual flush threshold door seal system was initially designed to operate with high-end folding doors over large residential exterior openings, but with the further development of the product it has been made evident that it will work in a wide variety of door thresholds providing improved access for wheelchairs. With the folding doors of the initial design fully open, the flexible weather seal can be put in the retracted or down position providing a flush access surface and may be raised by putting a finger in a slot at either end of the flexible weather seal raising it into the upright position. This type of folding door has a unique door hinge where the folding doors are offset from the roller guide track in which the rollers translate when the folding doors are opened and closed. With this offset of the hinge, the door faces of the folding doors rotate against the flexible weather seal. A secondary transverse door-locking cavity is adjacent to the roller guide track furnishing a locking means when the folding doors are in the closed position. The roller guide track and the door-locking cavity are components of the flush door seal aluminum extrusion.

A transverse pivot rod is incorporated into the design of the flush door seal aluminum extrusion providing a means for the flexible weather tight seal to pivot from the retracted or down position to the upright position. The flush door seal aluminum extrusion may be imbedded in a flush concrete surface but it must be understood that the flush door seal aluminum extrusion can be imbedded into a wide variety of building materials and still remain within the scope of this patent. At one or both ends of the flexible weather seal will be a finger slot as a means to manually raise the flexible weather seal to the upright position. The flexible weather seal can be lowered by stepping down anywhere along the surface. A transverse depression is located in the transverse cavity of the pivot rod and mates with a transverse raised section on the flexible weather seal to provide a restraint when the weather seal is raised to the upright position by pivoting on the transverse pivot rod.

In the automatic mode of the flush threshold door seal system the primary section of the flexible weather seal is raised automatically when the folding doors are closed. A short section of the flexible weather seal will remain in the upright position leaving clearance for the seal-lifting guides in that area. As the folding doors are closed, the seal-lifting guide travels within the door-locking cavity to raise the primary section of the flexible weather seal to the upright position. By stepping on the primary section of the flexible weather seal at any point, it can be pressed down to the flush position.

The alternate embodiment of the flush threshold door seal system may also be imbedded into a flush concrete surface although it must also understood that the alternate embodiment of the flush threshold door seal system can be embedded into a wide variety of door thresholds including the conventional thresholds with a step down landing on existing residences. The door seal aluminum extrusion would be similar but would not have the roller guide track or the door-locking cavity.

The foregoing has outlined rather broadly the more pertinent and important features of the flush threshold door seal system in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiments may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the flush threshold door seal system and together with the description, serve to explain the principles of this application.

For a fuller understanding of the nature and advantages of the flush threshold door seal system, reference should be had to the following detailed description taken in conjunction with the accompanying drawings which are incorporated in and form a part of this specification illustrates embodiments of the design and together with the description, serve to explain the principles of this application.

DETAILED DESCRIPTION OF THE PREFERRED EMBODIMENTS

Figure 1:
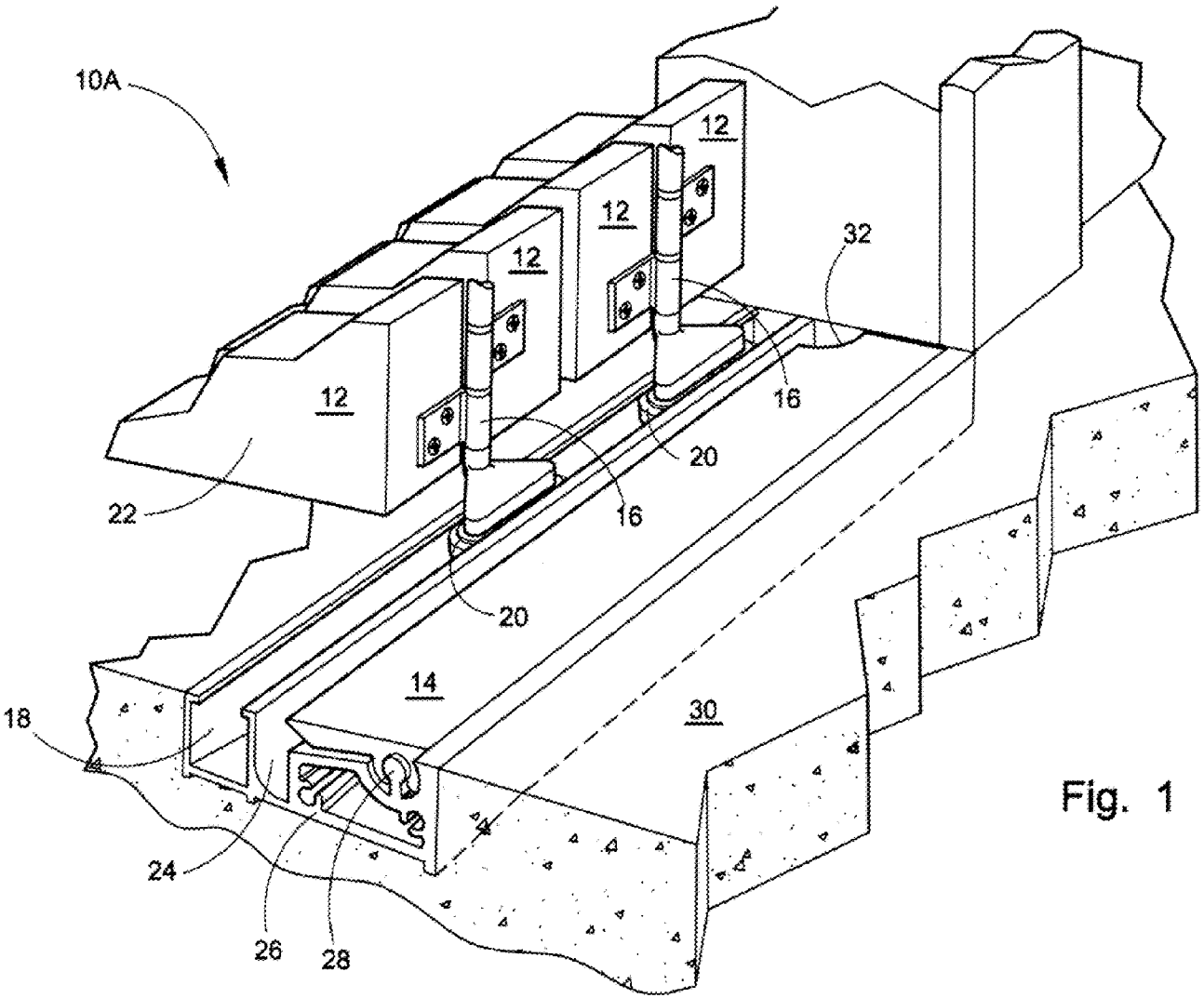
FIG. 1 depicts a perspective view of the flush threshold door seal system in the manual mode with the doors fully open and the flexible weather seal in the retracted position.

Referring now to the drawings, wherein similar parts of the flush threshold door seal system in the manual mode 10A and flush threshold door seal system in the automatic mode 10B along with the alternate embodiment of the flush threshold door seal system 10C are identified by like reference numerals. There is seen in FIG. 1 a perspective view of the flush threshold door seal system 10A with the folding doors 12 fully open and the flexible weather seal 14 in the retracted or down position. With this type of folding door 12, a unique door hinge 16 is used where the folding doors 12 are offset from the roller guide track 18 in which the rollers 20 translate when the folding doors 12 are opened and closed. With this offset of the hinge 16, the door faces 22 of the folding doors 12 rotate against the flexible weather seal 14. A secondary transverse door-locking cavity 24 is adjacent to the roller guide track 18 furnishing a locking means when the folding doors 12 are in the closed position. The roller guide track 18 and the door-locking cavity 24 are components of the flush door seal aluminum extrusion 26. A transverse pivot rod 28 is incorporated into the design of the flush door seal aluminum extrusion 26 providing a means for the flexible weather tight seal 14 to pivot from the retracted or down position to the upright position. The flush door seal aluminum extrusion 26 has been shown imbedded in a flush concrete surface 30 but it must be understood that the flush door seal aluminum extrusion 26 can be imbedded into a wide variety of building materials and still remain within the scope of this patent. At one or both ends of the flexible weather seal 14 will be a finger slot 32 as a means to manually raise the flexible weather seal 14 to the upright position. The flexible weather seal 14 can be lowered by stepping down anywhere along the surface.

Figure 2:
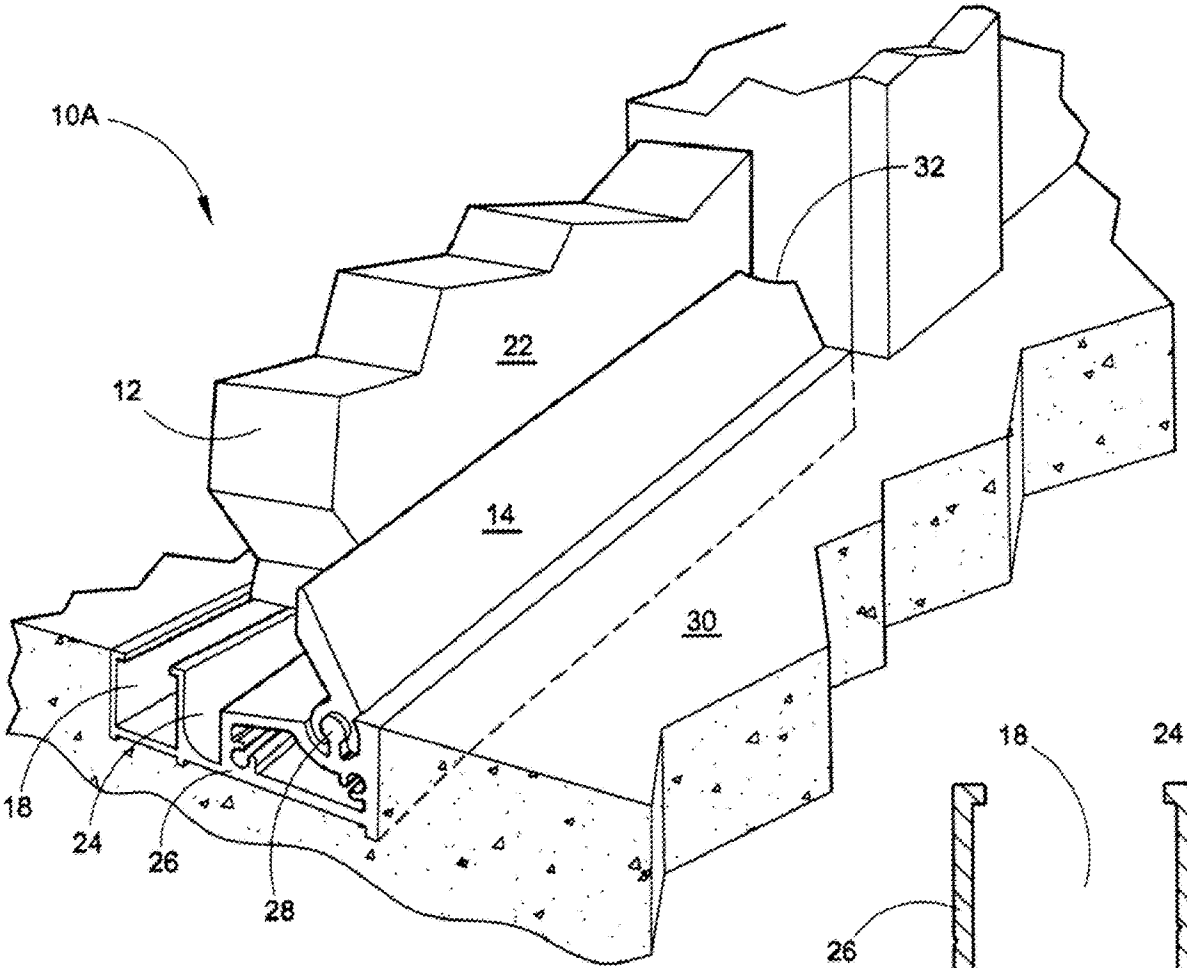
FIG. 2 depicts a perspective view of the flush threshold door seal system in the manual mode with a single folding door face against the flexible weather seal in the raised position.
Figure 3:
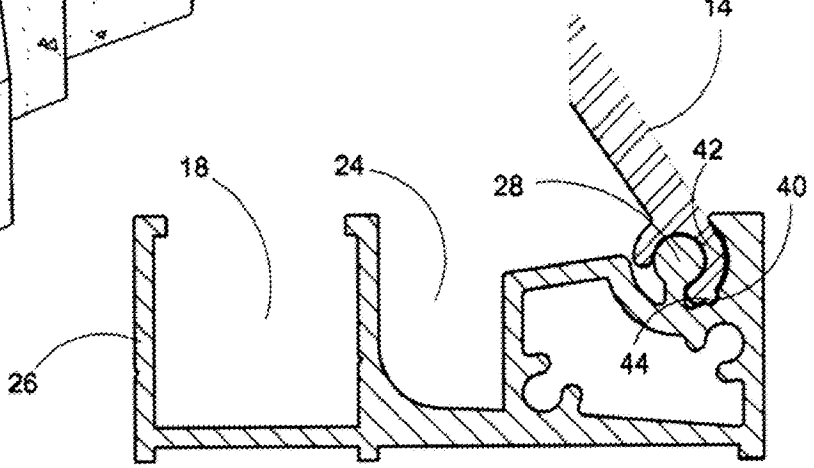
FIG. 3 depicts a cross section through the aluminum extrusion with the flexible weather seal in the raised position.
Figure 4:
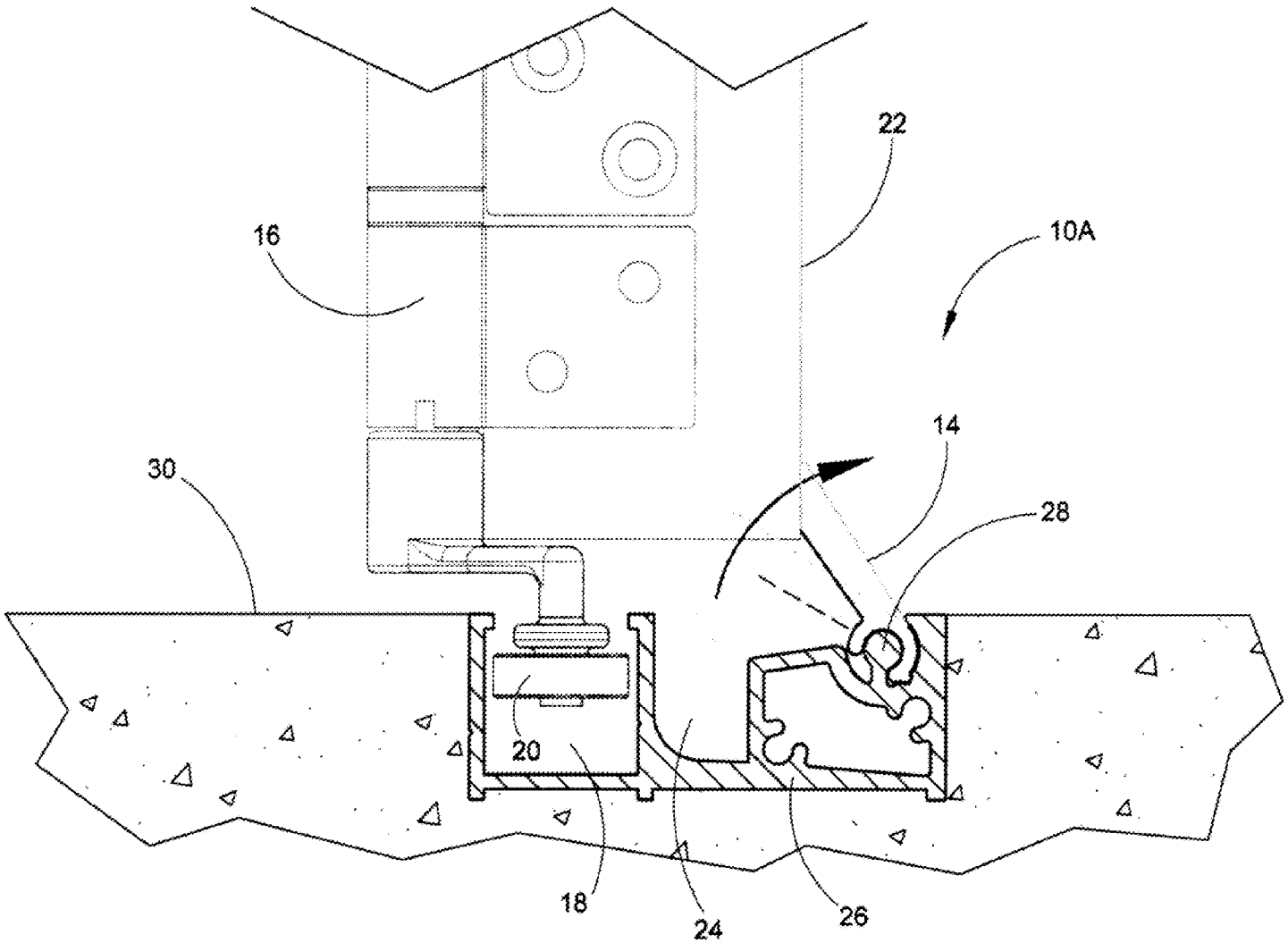
FIG. 4 depicts a section of the flush threshold door seal system in the manual mode imbedded into a flush surface illustrating the door in the closed position and the movement of the flexible seal to the up position.

FIG. 2 depicts a perspective view of the flush threshold door seal system 10A in the manual mode with a single folding door face 22 against the flexible weather seal 14 in the raised position. FIG. 3 depicts a cross section through the door seal aluminum extrusion 26 with the flexible weather seal 14 in the raised position. A transverse depression 40 located in the transverse cavity 42 of the pivot rod 28 mates with a transverse raised section 44 on the flexible weather seal 14 to provide a restraint for the flexible weather seal 14 when it is raised to the upright position by pivoting on the transverse pivot rod 28. FIG. 4 depicts a section of the flush threshold door seal system 10A in the manual mode imbedded into a flush concrete surface 30 illustrating the folding door 12 in the closed position and the movement of the flexible seal 14 to the up position. The roller 20 on the door hinge 16 is located within the roller guide track 18.

Figures 5, 6:
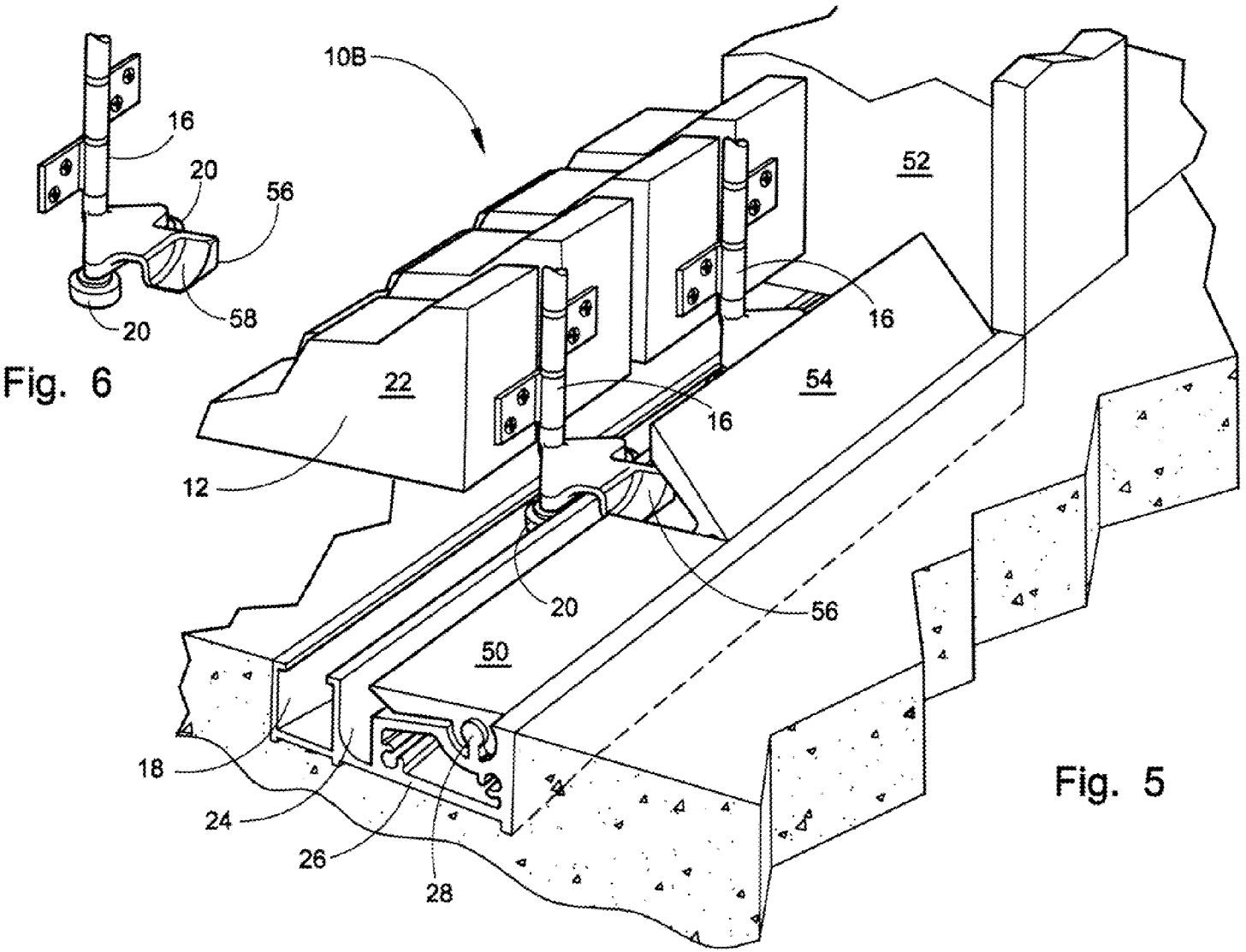
FIG. 5 depicts a perspective view of the flush threshold door seal system in the automatic mode where the flexible weather seal is raised automatically when the folding doors are closed.
FIG. 6 depicts a perspective view of the door hinge and rollers incorporating the seal-lifting guide.
Figure 7:
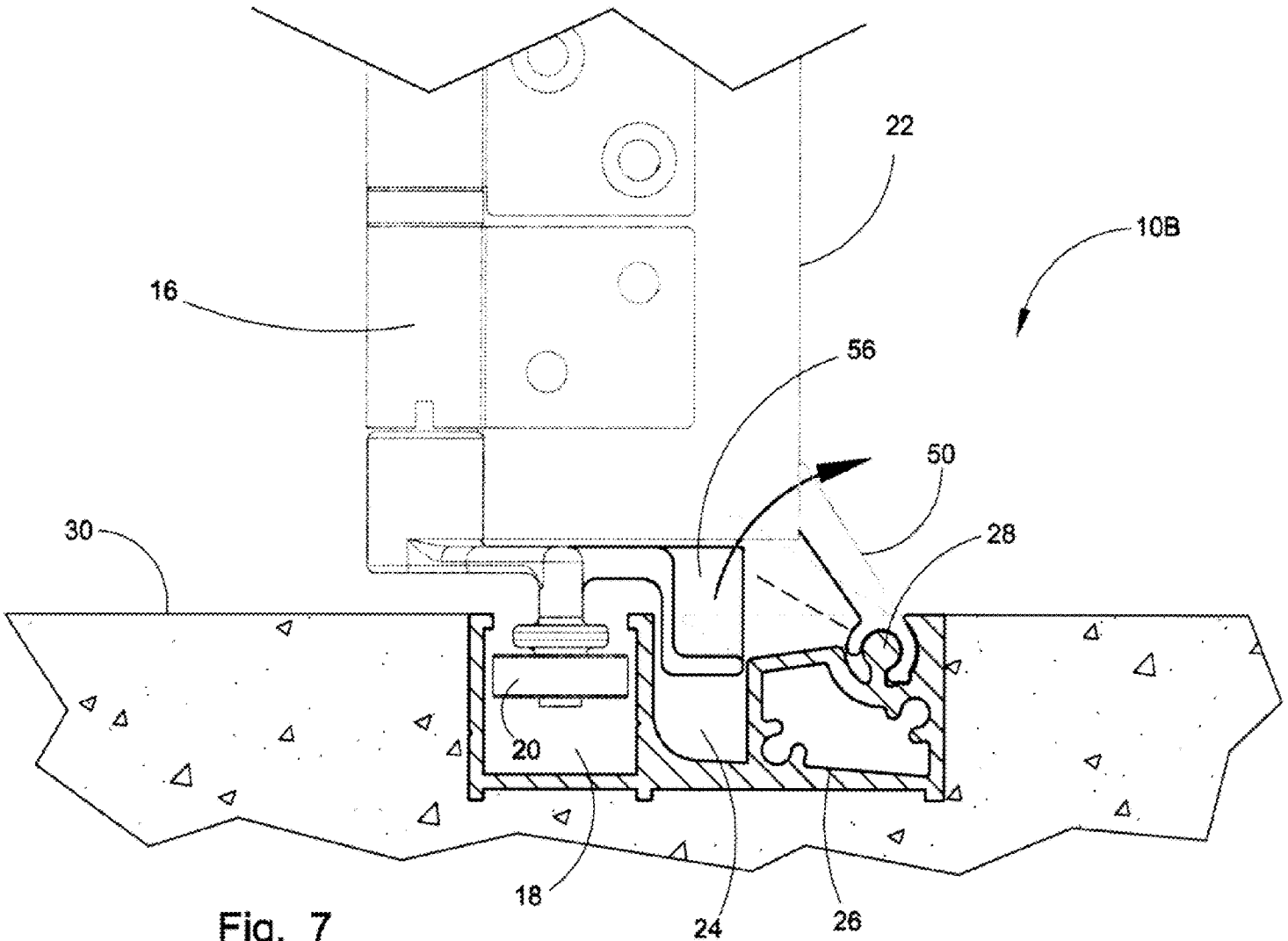
FIG. 7 depicts a cross section of the flush threshold door seal system in the automatic mode imbedded into a flush surface illustrating the door in the closed position and the movement of the flexible seal being raised by the seal lifting guide to the up position.

FIG. 5 depicts a perspective view of the flush threshold door seal system 10B in the automatic mode where the primary section of the flexible weather seal 50 is raised automatically when the folding doors 12 are closed. This view shows the folding doors 12 in the fully open position against the doorframe 52. A short section of the flexible weather seal 54 will remain in the upright position leaving clearance for the seal-lifting guides 56 in that area. As the folding doors 12 are closed, the seal-lifting guide 56 travels within the door-locking cavity 24 to raise the primary section of the flexible weather seal 50 to the upright position. By stepping on the primary section of the flexible weather seal 50 at any point, it can be pressed down to the flush position. FIG. 6 depicts a perspective view of the door hinge 16 and rollers 20 incorporating the seal-lifting guide 56 with a sloped section 58. FIG. 7 depicts a cross section of the flush threshold door seal system 10B in the automatic mode imbedded into a flush concrete surface 30 illustrating the folding door 12 in the closed position and the movement of the primary section of the flexible seal 50 being raised by the seal lifting guide 56 to the upright position.

Figure 9:
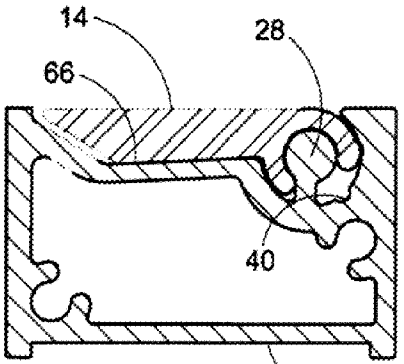
FIG. 9 depicts a cross section of the alternate embodiment of the flush threshold door seal system through the aluminum extrusion with the flexible weather seal in the lower position.
Figure 10:
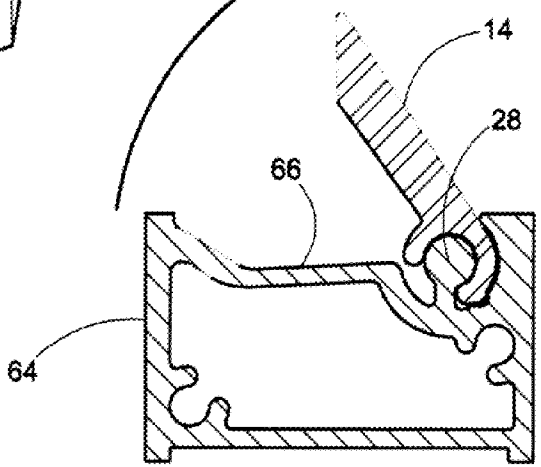
FIG. 10 depicts a cross section of the alternate embodiment of the flush threshold door seal system through the aluminum extrusion with the flexible weather seal in the raised position.
Figure 8:
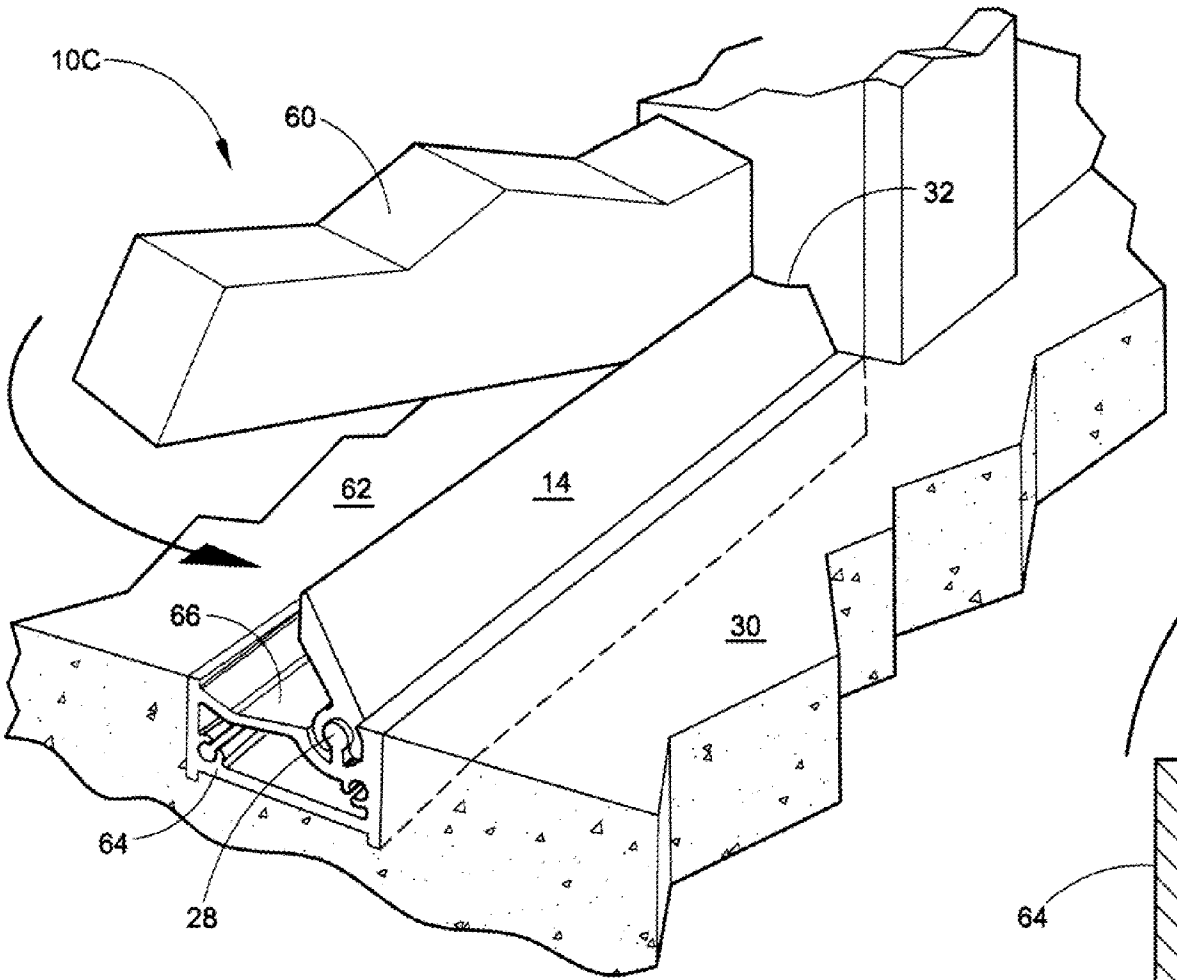
FIG. 8 depicts the alternate embodiment of the flush threshold door seal system imbedded into a flush surface illustrating the door movement against the flexible seal in the upright position.

FIG. 8 depicts the alternate embodiment of the flush threshold door seal system 10C imbedded into a flush concrete surface 30 illustrating the pivoting door 60 movement against the flexible seal 14 in the upright position. It must also understood that the alternate embodiment of the flush threshold door seal system 10C can be embedded into a wide variety of door thresholds 62 including the conventional thresholds 62 with a step down landing on existing residences. The door seal aluminum extrusion 64 would be similar but would not have the roller guide track 18 or the door-locking cavity 24. FIG. 9 depicts a cross section of the alternate embodiment of the flush threshold door seal system 10C through the aluminum extrusion 64 with the flexible weather seal 14 in the lower position in the weather seal mating cavity 66. FIG. 10 depicts a cross section of the alternate embodiment of the flush threshold door seal system 10C through the aluminum extrusion 64 with the flexible weather seal 14 in the raised position.

The flush threshold door seal systems 10A, 10B and 10C shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a flush threshold door seal systems 10A, 10B and 10C in accordance with the spirit of this disclosure. Such changes, alternations and modifications as would occur to those skilled in the art are considered to be within the scope of the flush threshold door seal systems as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A zero step sill flush threshold door seal system comprising:

(a) an extruded sill configured for folding doors incorporating one or more roller guide tracks having rollers that translate when the folding doors are opened and closed;

(b) an offset folding door hinge used where the folding doors are offset;

(c) a transverse door-locking cavity adjacent to said roller guide tracks, providing a locking means when the folding doors are in the closed position; and (d) a single integral flexible weather seal capable of being manually positioned in an up position when the folding doors are closed for weather sealing, or in a retracted down position, flush with said extruded sill, when the folding doors are open.

2. The zero step sill flush threshold door seal system according to claim 1, further comprising a transverse pivot rod incorporated into the flush door seal aluminum extrusion providing a means for the flexible weather tight seal to pivot from the retracted down position, flush with said extruded sill, to the upright position for weather sealing.

3. The zero step sill flush threshold door seal system according to claim 2, wherein said flexible weather seal is constructed of natural or synthetic rubber.

4. The zero step sill flush threshold door seal system according to claim 3, wherein said flexible weather seal includes a finger slot for manual lifting of said flexible weather seal into the upright position for weather sealing.

5. A zero step sill flush threshold door seal system comprising:

(a) an extruded sill configured for folding doors incorporating one or more roller guide tracks having rollers that translate when the folding doors are opened and closed;

(b) an offset folding door hinge used where the folding doors are offset;

(c) a transverse door-locking cavity adjacent to said roller guide tracks, providing a locking means when the folding doors are in the closed position; and (d) a multiple sectioned flexible weather seal capable of being automatically positioned in an up position when the folding doors are closed for weather sealing, or in a retracted down position, flush with said extruded sill, when the folding doors are open; and (e) a seal lifting guide having a seal lifting guide sloped section located on said offset folding door hinge that moves transversely within said door locking cavity and automatically raises said flexible weather seal into the upright position for weather sealing when the folding doors are closed.

6. The zero step sill flush threshold door seal system according to claim 5, further comprising a transverse pivot rod incorporated into the flush door seal aluminum extrusion providing a means for the flexible weather tight seal to pivot from the retracted down position, flush with said extruded sill, to the upright position for weather sealing.

7. The zero step sill flush threshold door seal system according to claim 1, wherein said multiple sectioned flexible weather seal includes a primary section and one or more short sections.

8. The zero step sill flush threshold door seal system according to claim 1, wherein said flexible weather seal is constructed of natural or synthetic rubber.

9. The zero step sill flush threshold door seal system according to claim 1, wherein said extruded sill configured for folding doors incorporating one or more roller guide tracks is embedded into the floor surface such that said extruded sill is flush with the floor surface.

10. The zero step sill flush threshold door seal system according to claim 5, wherein said extruded sill configured for folding doors incorporating one or more roller guide tracks is embedded into the floor surface such that said extruded sill is flush with the floor surface.

11. A method for making a zero step sill flush threshold door seal system comprising the steps of:

(a) providing an extruded sill configured for folding doors incorporating one or more roller guide tracks having rollers that translate when the folding doors are opened and closed;

(b) providing an offset folding door hinge used where the folding doors are offset;

(c) providing a transverse door-locking cavity adjacent to said roller guide tracks, providing a locking means when the folding doors are in the closed position; and (d) providing a single integral flexible weather seal capable of being manually positioned in an up position when the folding doors are closed for weather sealing, or in a retracted down position, flush with said extruded sill, when the folding doors are open.

12. The method for making a zero step sill flush threshold door seal system according to claim 11, wherein a transverse pivot rod is incorporated into the design of the flush door seal aluminum extrusion providing a means for the flexible weather tight seal to pivot from the retracted or down position to the upright position.

13. The method for making a zero step sill flush threshold door seal system according to claim 11, wherein said step of providing a single integral flexible weather seal further includes the step of providing a single integral flexible weather seal wherein said flexible weather seal includes a finger slot for manual lifting of said flexible weather seal into the upright position for weather sealing.

14. The method for making a zero step sill flush threshold door seal system according to claim 11, wherein said step of providing a single integral flexible weather seal further includes the step of providing a single integral flexible weather seal wherein said flexible weather seal is constructed of natural or synthetic rubber.

15. The method for making a zero step sill flush threshold door seal system according to claim 11, further comprising the steps of (a) a multiple sectioned flexible weather seal capable of being automatically positioned in an up position when the folding doors are closed for weather sealing, or in a retracted down position, flush with said extruded sill, when the folding doors are open; and (b) a seal lifting guide having a seal lifting guide sloped section located on said offset folding door hinge that moves transversely within said door locking cavity and automatically raises said flexible weather seal into the upright position for weather sealing when the folding doors are closed.

16. The method for making a zero step sill flush threshold door seal system according to claim 15, further comprising the step of providing a transverse pivot rod incorporated into the flush door seal aluminum extrusion providing a means for the flexible weather tight seal to pivot from the retracted down position, flush with said extruded sill, to the upright position for weather sealing.

17. The method for making a zero step sill flush threshold door seal system according to claim 15, wherein said step of providing a multiple sectioned flexible weather seal includes the step of providing a sectioned flexible weather seal wherein said multiple sectioned flexible weather seal includes a primary section and one or more short sections.

18. The method for making a zero step sill flush threshold door seal system according to claim 15, wherein said step of providing a multiple sectioned flexible weather seal includes the step of providing a sectioned flexible weather seal wherein said multiple sectioned flexible weather seal is constructed of natural or synthetic rubber.

19. The method for making a zero step sill flush threshold door seal system according to claim 15, wherein said step of providing an extruded sill configured for folding doors incorporating one or more roller guide tracks includes the step of providing an extruded sill wherein said extruded sill configured for folding doors incorporating one or more roller guide tracks is embedded into the floor surface such that said extruded sill is flush with the floor surface.

20. The method for making a zero step sill flush threshold door seal system according to claim 16, wherein said step of providing a transverse pivot rod further includes the step of providing a transverse pivot rod having a transverse raised section and further wherein said transverse rod is housed a surrounding transverse cavity including a transverse depression, whereby when said flexible weather seal is raised to the upright position, said transverse raised section thereon mates with said transverse depression located within said transverse cavity to provide a friction restraint to help keep the flexible weather seal in the upright position.

* * * * *